US005735593A

United States Patent [19]

Gallant et al.

[11] Patent Number: 5,735,593

[45] Date of Patent: Apr. 7, 1998

[54] LIGHT FIXTURE APPARATUS FOR A HOSPITAL ROOM

[75] Inventors: Dennis J. Gallant, Harrison, Ohio; Dale A. Nobbe, Oldenburg, Ind.; John D. Vogel, Columbus, Ind.; Edward W. Catton, New Palestine, Ind.

[73] Assignee: Hill-Rom, Inc., Batesville, Ind.

[21] Appl. No.: 705,214

[22] Filed: Aug. 29, 1996

[51] Int. Cl.[6] ..... F21S 3/00; F21V 33/00

[52] U.S. Cl. ..... 362/147; 362/220; 362/225; 362/287; 362/372; 362/801; 362/427

[58] Field of Search ..... 362/147, 217, 362/220, 221, 222, 223, 225, 285, 287, 368, 372, 801, 427, 249, 250, 251; 248/223.41, 225.11

[56] References Cited

U.S. PATENT DOCUMENTS

| | | | |
|---|---|---|---|
| 2,998,508 | 8/1961 | Bobrick | 362/801 |
| 3,084,247 | 4/1963 | Bobrick | 362/801 |
| 3,354,301 | 11/1967 | Bobrick | 362/147 |
| 3,660,591 | 5/1972 | Schultz et al. . | |
| 3,702,928 | 11/1972 | Alger . | |
| 3,769,502 | 10/1973 | Schultz et al. . | |
| 3,919,540 | 11/1975 | Burst et al. . | |
| 4,204,274 | 5/1980 | Luderitz . | |
| 4,646,211 | 2/1987 | Gallant et al. | 362/801 |
| 4,651,258 | 3/1987 | Davis et al. . | |
| 4,891,897 | 1/1990 | Gieske et al. | 248/225.11 |

OTHER PUBLICATIONS

The Horizon™ Headwall System From Hill-Rom®, Hill-Rom Advertising Literature, 16 pages, 1994.

*Primary Examiner*—Thomas M. Sember
*Attorney, Agent, or Firm*—Barnes & Thornburg

[57] ABSTRACT

A light fixture apparatus is configured to be mounted to a wall. The apparatus includes support frame configured to be mounted to the wall. The support frame is formed to include a track. The support frame also includes first and second support walls which are configured to be mounted generally parallel to the wall of the room and a web interconnecting the first and second support walls. A light box is coupled to the support frame. The light box includes a light source. The apparatus further includes a mounting block configured to be coupled to the track of the support. The mounting block is adapted to receive an accessory item to couple the accessory item to the support frame.

18 Claims, 5 Drawing Sheets

LIGHT FIXTURE APPARATUS FOR A HOSPITAL ROOM

BACKGROUND AND SUMMARY OF THE INVENTION

The present invention relates to a light fixture apparatus for mounting on a wall of a room, such as in a hospital room. More particularly, the present invention relates to a light fixture apparatus which facilitates mounting of accessory items to the wall to facilitate equipment management within the hospital room.

Some conventional hospital rooms are provided with a track mounted on a wall of the hospital room. When the track is installed, back plating must be added behind the wall in order to support devices such as accessory items coupled to the track. The track includes an electrical raceway for providing power to the track. Light fixtures or other devices are then mounted on the track in a desired position.

The light fixture apparatus of the present invention is designed to support heavy devices such as a patient monitor arm which can weigh 80 pounds or more. The light fixture apparatus of the present invention does not require back plating to be installed behind the wall. This facilitates installation of the light fixture apparatus. The customer simply installs the light fixture apparatus of the present invention by anchoring the light fixture to studs of the wall. The customer then can install a monitor arm, or any other designed accessories onto a track formed on the light fixture without doing any further construction to the wall.

Heavy pieces of equipment are anchored to the light fixture apparatus with a mounting block fastener. The present invention also includes an accessory mounting block which is easily installed onto and released from the track on the light fixture to support smaller accessory items.

The light fixture apparatus of the present invention also provides an enhanced examination lighting feature. The light fixture apparatus preferably includes auxiliary quartz halogen lamps. The auxiliary lights are small spotlights which can be directed toward the patient. Preferably, a pair of the lamps are mounted at opposite ends of the light fixture.

According to one aspect of the present invention, a light fixture apparatus is configured to be mounted to a wall. The apparatus includes support frame configured to be mounted to the wall. The support frame is formed to include a track. The support frame also includes first and second support walls which are configured to be mounted generally parallel to the wall of the room and a web interconnecting the first and second support walls. A light box is coupled to the support frame. The light box includes a light source. The apparatus further includes a mounting block configured to be coupled to the track of the support. The mounting block is adapted to receive an accessory item to couple the accessory item to the support frame.

In the illustrated embodiment, the support frame includes a first support member configured to define the track and a second support member coupled to the first support section for supporting the light box. The first support member is illustratively made from an extruded metal material, preferably aluminum. The second support member is illustratively made from a sheet metal material or an aluminum extrusion.

The light box is coupled to the support frame by fasteners which permit limited movement of the light box relative to the support. The apparatus further includes a switch coupled to the support frame for disconnecting power to a hospital bed power supply. The switch is configured to engage the light fixture upon movement of the light fixture a predetermined distance relative to the support frame.

The apparatus further includes an auxiliary light source coupled to the support frame. The auxiliary light source is movable from a first storage position to a second deployed position for providing auxiliary lighting. In one illustrated embodiment, the auxiliary light source is pivotably coupled to the support frame above the light box.

In another illustrated embodiment, first and second auxiliary light source modules are coupled to the support frame at opposite ends of the light box. The first and second auxiliary light modules are pivotable upwardly to direct first and second auxiliary light sources toward a patient.

In yet another illustrated embodiment, the first and second auxiliary light modules include a top fixed compartment portion and a bottom movable compartment portion. The movable compartment portion is pivotable downwardly to expose first and second auxiliary light sources within the first and second auxiliary light modules.

The apparatus still further includes first and second hollow housing portions coupled to the support frame opposite sides of the light box. The first and second housing portions are pivotably coupled to the support frame. This provides a means to conceal electrical and communication outlets and excess cords. In addition, it can provide a passageway for additional electrical conduits originating from a supply chase.

The illustrated support frame is formed to include first and second stops adjacent the track. The mounting block is an S-shaped mounting block having a top end configured to engage the first stop and a bottom end configured to engage the second stop. The track is formed to include a recessed portion for receiving a fastener for coupling the mounting block to the accessory item.

One illustrated mounting block is formed to include a top end for engaging the first stop and a release latch pivotably coupled to the mounting block. The release latch includes a locking boss configured to engage the second stop to hold the mounting block within the track. The release latch is biased to a locking position by a spring coupled between the release latch and the mounting block.

Additional objects, features, and advantages of the invention will become apparent to those skilled in the art upon consideration of the following detailed description of the preferred embodiment exemplifying the best mode of carrying out the invention as presently perceived.

BRIEF DESCRIPTION OF THE DRAWINGS

The detailed description particularly refers to the accompanying figures in which.

DETAILED DESCRIPTION OF THE DRAWINGS

Figure 1:
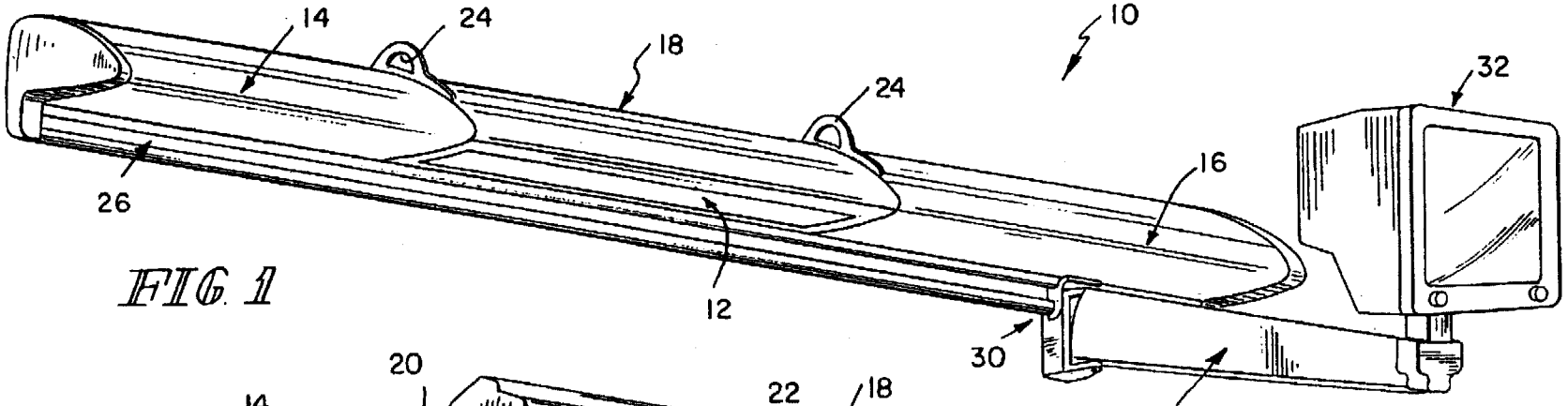
FIG. 1 is a perspective view of the light fixture apparatus of the present invention with a monitor arm attached to a track on the light fixture.
Figure 2:
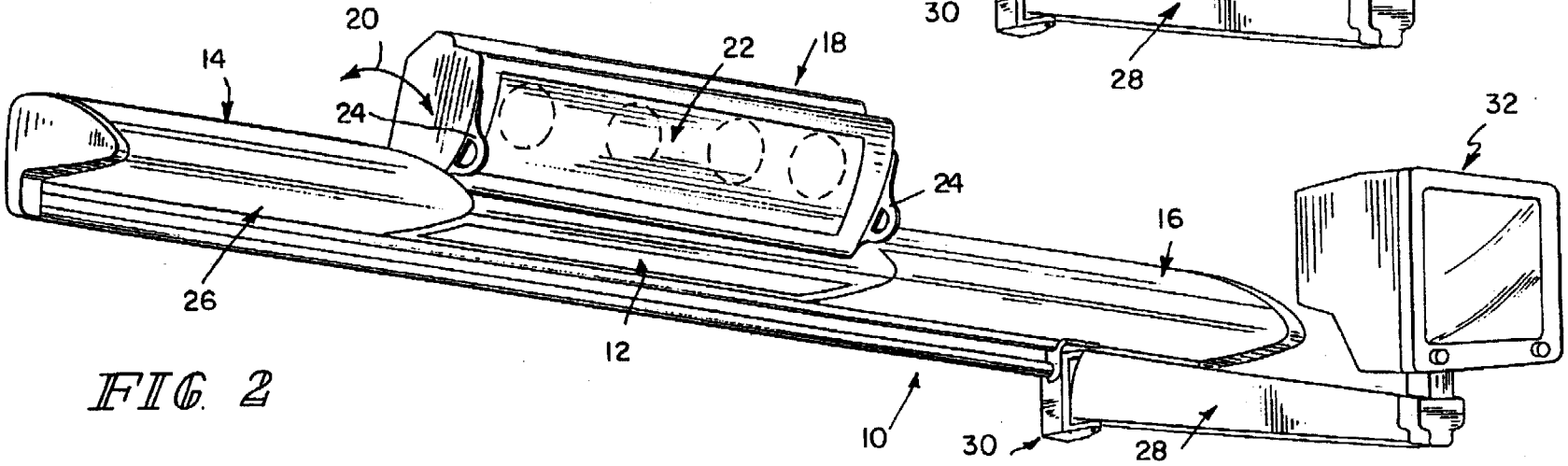
FIG. 2 is a perspective view similar to the FIG. 1 in which a central auxiliary light has been flipped over to provide increased lighting for a patient in the room.

Referring now to the drawings, FIGS. 1 and 2 illustrate a light fixture apparatus 10 of the present invention. The light fixture 10 includes a central light box 12 for holding a light source therein. The light fixture 10 also includes hollow end portions 14 and 16 on opposite sides of the light box. A flip-out auxiliary light source 18 is located above light box 12. As illustrated in FIG. 2, the auxiliary light source 18 is pivotable in the directions of double-headed arrow 20 to direct the auxiliary light source 22 toward a patient, such as during an exam. Handles 24 are provided on opposite ends of the auxiliary light 18.

Light fixture 10 further includes an accessory track 26 for mounting accessory items onto the light fixture 10. For instance, a monitor arm 28 can be coupled to the track 26 with a fastener assembly 30 best disclosed in FIG. 3. A monitor 32 is cantilevered from the track 26 by the monitor arm 28 and fastener assembly 30.

Figure 3:
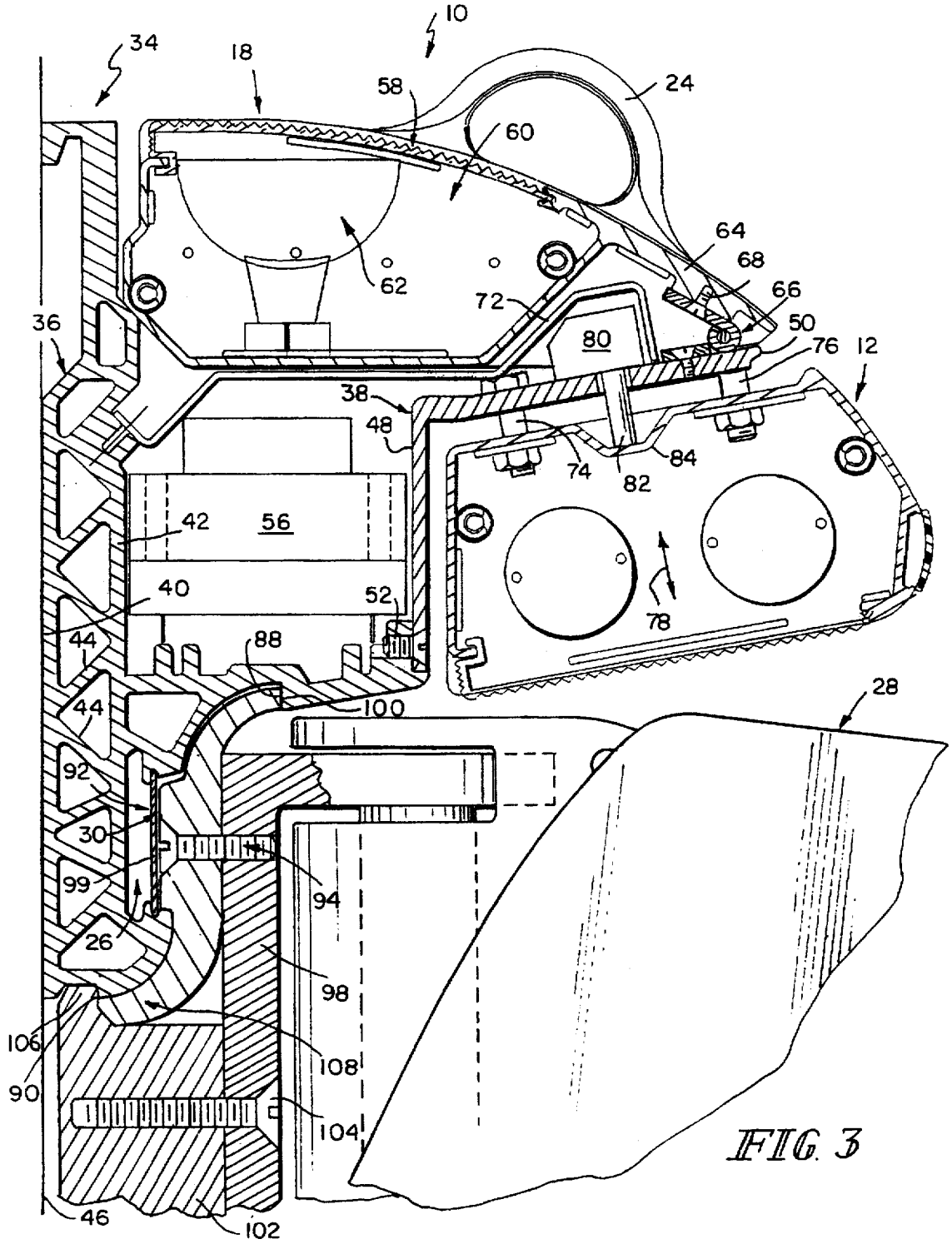
FIG. 3 is a sectional view taken through the light fixture apparatus of FIG. 1 illustrating a reinforced support member and a first mounting bracket assembly for securing a heavy piece of equipment such as the monitor arm to the light fixture apparatus.

Details of the light fixture 10 are illustrated in FIG. 3. Light fixture 10 is designed to be mounted directly to studs of a wall 46. In most instances, the light fixture 10 permits mounting of accessory items such as the monitor 32 onto track 26 without the use of back plating behind the wall. This facilitates installation of the light fixture 10.

Light fixture 10 includes a reinforced support frame 34 having a first support member 36 and a second support member 38. Preferably, first support member 36 is formed from an extruded metal material, such as aluminum for strength. First support 36 includes a pair of parallel support walls 40 and 42 interconnected by webs 44. Therefore, the first support provides a reinforced support assembly for the light fixture 10. The first support member 36 is coupled directly to studs in a wall 46 to secure the light fixture 10 to the wall 46. In most instances, back plating is not required for the light fixture 10 due to the reinforced support 34.

The second support member 38 is preferably made from sheet metal and has a first, vertically extending section 48 and a second, generally horizontally extending section 50. Second support member 38 is coupled to the first support member 36 by suitable fasteners 52. An interior region 54 is defined between the first support 36 and the second support member 38 for receiving components such as a ballast 56.

The auxiliary light source 18 includes a housing 58 defining an interior region 60 for holding the auxiliary light source 62. Illustratively, the auxiliary light source 62 is a halogen lamp. However, any light source may be used. A front wall 64 of housing 58 is coupled to horizontal leg 50 of second support 38 by hinges 66. The first side of each hinge 66 is coupled to the wall 64 by a fastener 68. A second side of each hinge 66 is coupled to horizontal leg 50 by fastener 70. An internal sheet metal cover 72 is provided for protecting and shielding internal parts of the light fixture 10 when the auxiliary light 18 is flipped to its open position illustrated in FIG. 2.

Light box 12 is coupled to horizontal leg 50 by fasteners 74 and 76. Fasteners permit limited movement of the light box 12 relative to horizontal leg 50 in the directions of double-headed arrow 78. A switch 80 is also coupled to horizontal leg 50. Switch 80 includes a plunger 82 configured to deactivate the bed when plunger 82 is engaged. In other words, if an item makes contact with light box 12 and pushes the light box 12 upwardly toward horizontal leg 50, a top surface 84 of light box 12 engages plunger 82 to deactivate movement of the bed. The obstruction must be cleared to release the plunger 82 in order to restore power to move the bed.

FIG. 3 also illustrates further details of the mounting track 26 and the fastener assembly 30. The mounting track 26 is a generally S-shaped track including a first, upper stop 88 and a second, lower stop 90. A recessed portion 92 of track 26 provides room for a fastener 94.

Fastener assembly 30 includes a S-shaped mounting block 96 configured to be coupled to a desired item such as bracket 98 of monitor arm 28 by the fastener 94. A HPL laminate facia insert 99 is coupled to first support member 36 adjacent track 26. A top end 100 of mounting block 96 is configured to abut the first stop 88 on support 36. Mounting bracket 98 is also secured to a second mounting block 102 by fastener 104. Mounting block 102 is formed to include a top flange 106 configured to engage the second stop 90 of the support member 36. A bottom end 108 of mounting block 96 is trapped between support member 36 and mounting block 102.

Figure 4:
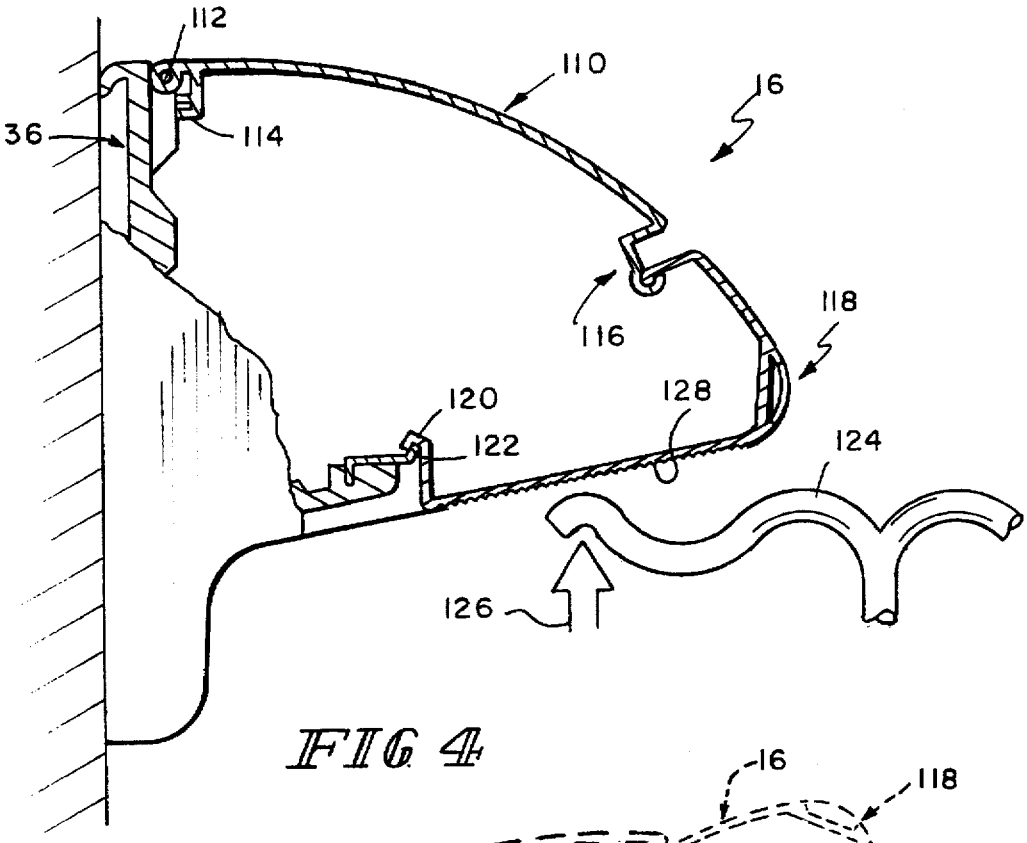
FIG. 4 is a diagrammatical sectional view illustrating an end cover of the light fixture apparatus.
Figure 5:
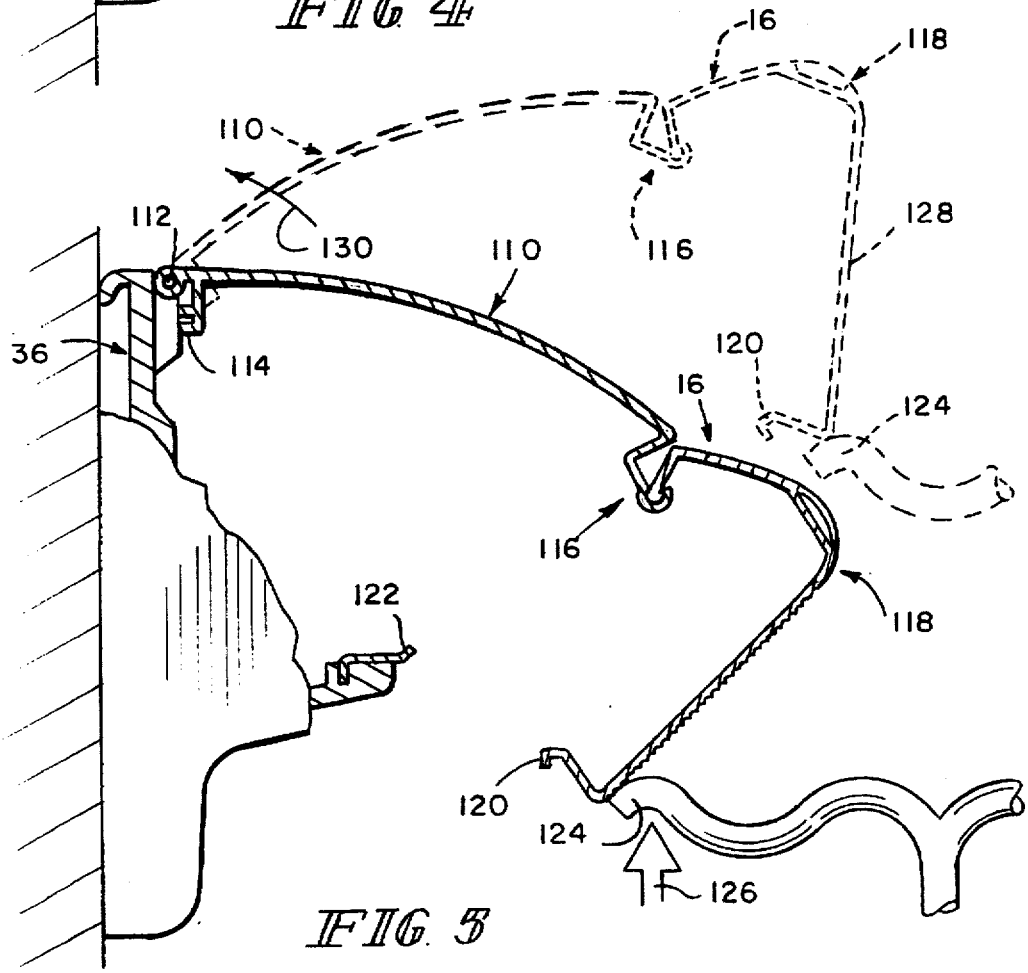
FIG. 5 is a sectional view similar to FIG. 4 in which the end cover has been engaged by an item and moved upwardly to avoid breaking the cover.

FIGS. 4 and 5 illustrate the configuration of the hollow end portions 14 and 16 of the light fixture 10. A movable cover 110 is coupled to support 36 by a hinge 112. Standoff feet 114 engage support 36 to hold the cover 110 in the position illustrated in FIG. 4. A living hinge 116 is formed in cover 110 near nose 118. A hook 120 is formed to on a second end of cover 110. Hook 120 is configured to engage a lip 122 formed on support 36 to hold the cover 110 in the position illustrated in FIG. 4.

Covers 110 are designed to move if forces applied to cover 110. For instance, if an IV pole 124 or other item moves upwardly in the direction of arrow 126 to engage a bottom surface 128 of cover 110, the cover 110 then pivots upwardly to the position illustrated in FIG. 5. Cover 110 is able to pivot in the direction of arrow 130 about hinge 112 to the solid line position of FIG. 5. Further upward movement of the item 124 causes the pivotable movement of nose 118 of cover 110 about hinge 116 as illustrated by the dotted lines in FIG. 5. This reduces the likelihood that the covers 110 will be broken by engaging the item 124.

Figure 6:
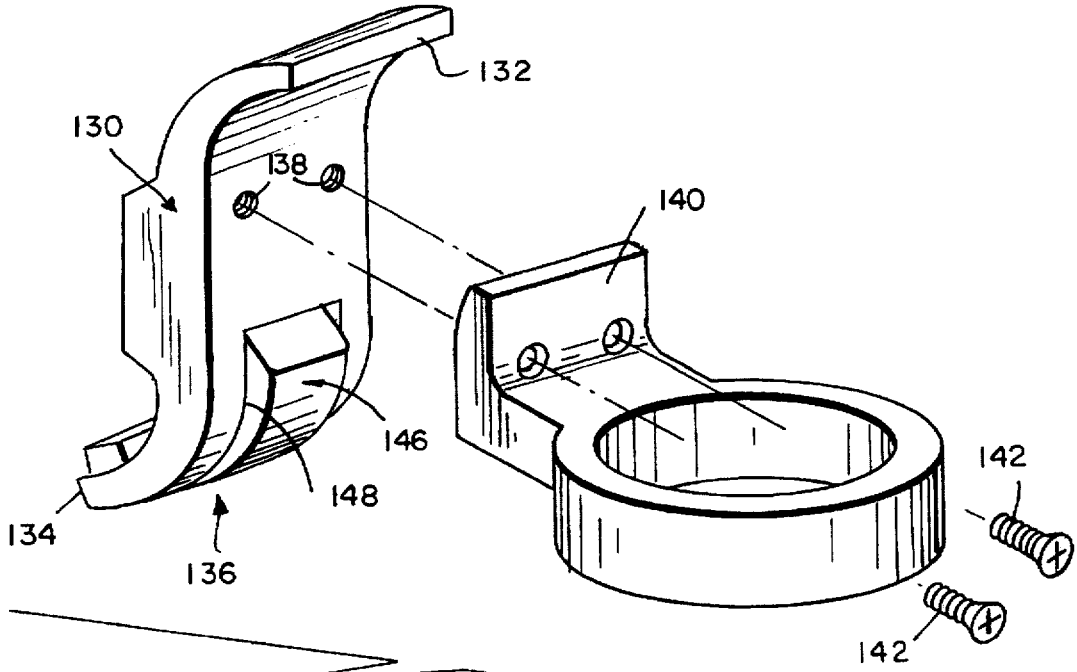
FIG. 6 is a perspective view of an accessory mount for coupling accessory items to the track of the light fixture.
Figure 7:
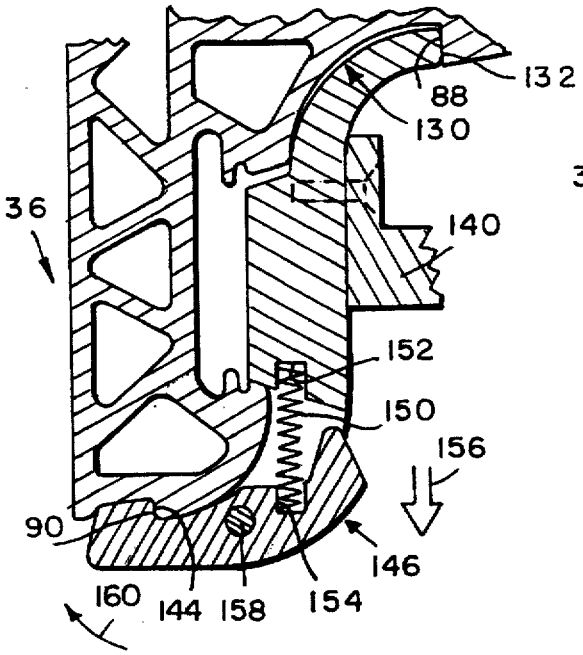
FIG. 7 is a sectional view illustrating the accessory mount of FIG. 6 mounted in the track of the light fixture.
Figure 8:
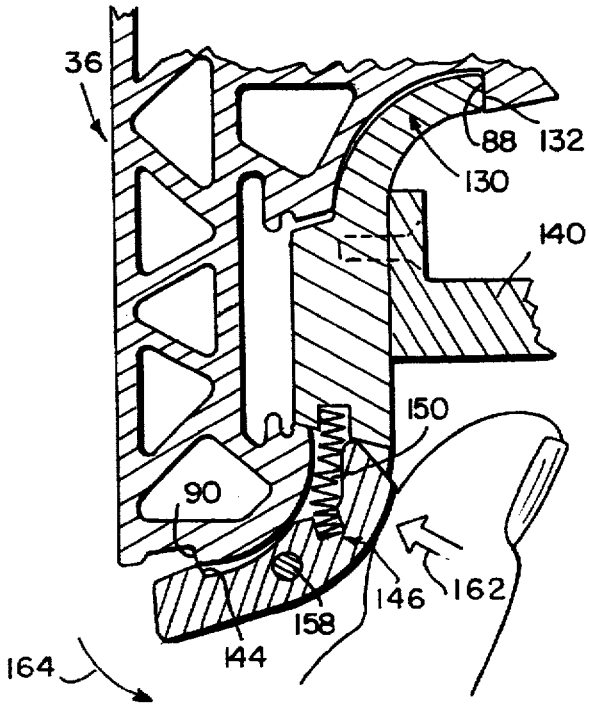
FIG. 8 is a sectional view similar to FIG. 7 illustrating release of the accessory mount from the track.

Another embodiment of a mounting block 130 for use with the light fixture 10 is illustrated in FIGS. 6–8. FIG. 6 illustrates a S-shaped mounting block 130 having a top end 132, a bottom end 134, and a release latch 136 pivotably coupled to the mounting block 130. A pair of apertures 138 are provided for securing an accessory item 140 to the mounting block 130 with suitable fasteners 142. It is understood that any type of accessory item may be secured to track 26 by mounting block 130.

As illustrated in FIG. 7 and 8, release latch 136 is formed to include a locking boss 144 and an actuator section 146. Release latch 136 is located within a slot 148 formed in mounting block 130. A spring 150 extends between an aperture 152 formed in mounting block 130 and an aperture 154 formed in release latch 136. Spring 150 applies a downwardly directed biasing force in the direction of arrow 156 to move the locking boss 144 upwardly about pivot axis 158 in the direction of arrow 160 to a locked position. When in the locked position, the top end 132 of mounting block 130 engages the first stop 88 of support 36. Locking boss 144 engages the second stop 90 of support 36 to hold mounting block 130 in place on the track 26.

When it is desired to release the mounting block 130, a force is applied to the release latch in the direction of arrow 162 of FIG. 8. This causes locking boss 144 to pivot about axis 158 in the direction of arrow 164 so that the locking boss 144 is disengaged from stop 90 to release the mounting block 130 from track 26.

Figure 9:
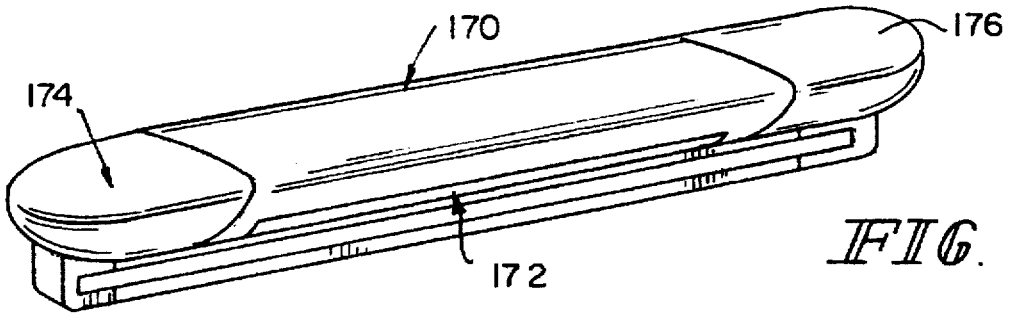
FIG. 9 is a perspective view of another embodiment of the light fixture.
Figure 10:
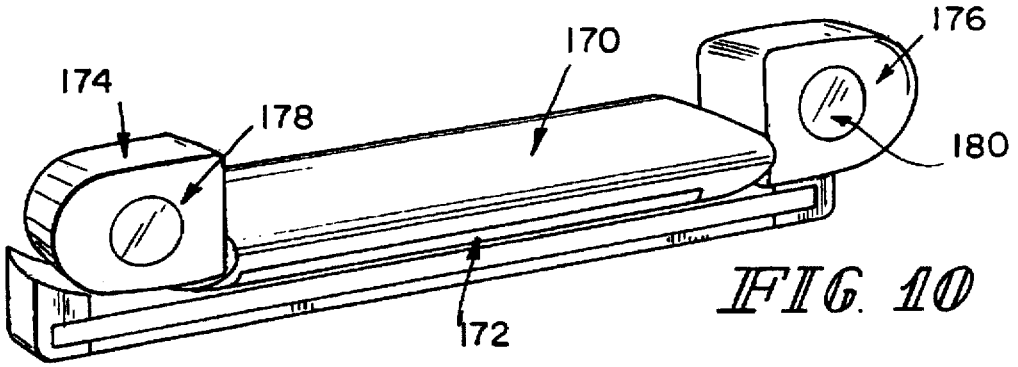
FIG. 10 is a perspective view of the light fixture of FIG. 9 with end lamps pivoted upwardly to provide additional lighting for the patient.

Another embodiment of the present invention is illustrated in FIGS. 9 and 10. In this embodiment, an auxiliary lighting design is provided for increased lighting on a patient in the room during an examination procedure or the like. As shown in FIG. 9, a light fixture 170 includes a central light box 172 and end modules 174 and 176. The auxiliary light modules 174 and 176 are capable of being pivoted upwardly to expose light sources 178 and 180 located within modules 174 and 176, respectively. These modules 174 and 176 can be linked by a bar so that they rotate together, if desired. In addition, the modules 174 and 176 can be independently movable. Preferably, light sources 178 and 180 are quartz halogen lamps. However, any type of light source may be used. The pivoting modules 174 and 176 provide smaller, high intensity spotlights which can be directed toward the patient.

Figure 11:
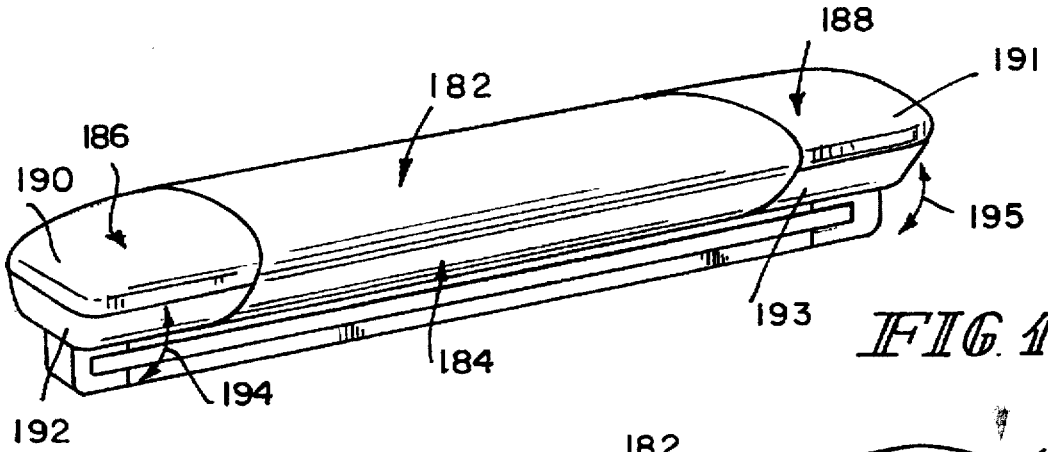
FIG. 11 is a perspective view of yet another embodiment of the present invention.
Figure 12:
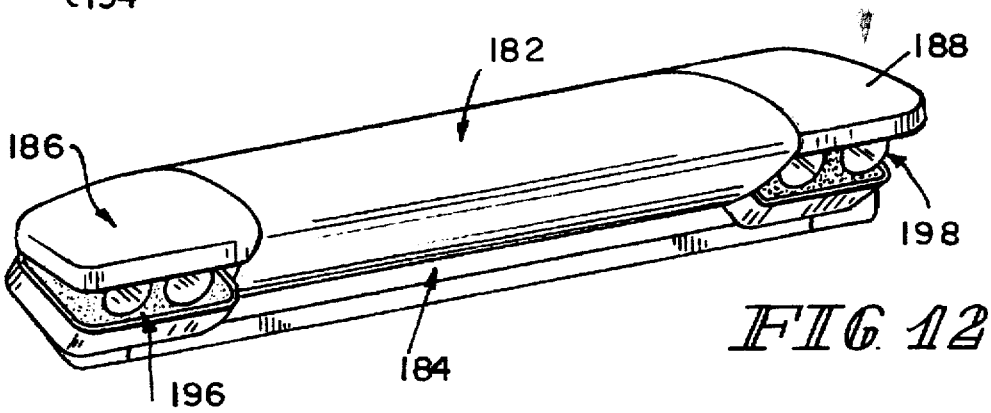
FIG. 12 is a perspective view of the light fixture apparatus of FIG. 11 in which bottom portions end modules have been dropped down to expose auxiliary lamps in the end modules for improved lighting of the patient.

Another embodiment of the present invention is illustrated in FIGS. 11–12. A light fixture 182 includes a central light box 184 for normal room lighting. End modules 186 and 188 are also provided. End modules 186 and 188 include top, fixed compartment and a bottom, pivotable compartment 192 which is movable in the direction of double-headed arrows 194.

When it is desired to enhance lighting during an examination procedure or the like, bottom compartments 192, 193 are pivoted to downward positions as illustrated in FIG. 12. This exposes a light source 196 in module 186 and a light source 198 in module 188. The light sources 196 and 198 may be adjusted so that the light is increased on the patient. Light fixtures 170 and 182 may include the reinforced support structure illustrated in FIG. 3, or any type of mounting apparatus for securing the light fixtures 170 and 182 to a wall.

Although the invention has been described in detail with reference to certain preferred embodiments, variations and modifications exist within the scope and spirit of the present invention as described and defined in the following claims.

What is claimed is:

1. A light fixture apparatus configured to be mounted to a wall of a room, the apparatus comprising:

a unitary support frame including first and second support walls configured to be mounted generally parallel to the wall of the room and a web interconnecting the first and second support walls and including a track in one of the support walls;

a light box coupled to the support frame above the track the light box including a light source; and a mounting block configured to mate with and be coupled to the track of the support frame, the mounting block being adapted to receive an accessory item to couple the accessory item to the support frame.

2. The apparatus of claim 1, wherein the support frame is made from an extruded metal material.

3. The apparatus of claim 1, wherein the support frame includes a first support member configured to define the track and a second support member coupled to the first support section for supporting the light box.

4. The apparatus of claim 3, wherein the second support member is made from a sheet metal material.

5. The apparatus of claim 1, wherein the light box is coupled to the support frame by fasteners which permit limited movement of the light box relative to the support.

6. The apparatus of claim 1, further comprising a switch coupled to the support frame for disconnecting power to a hospital bed power supply, the switch being configured to engage the light box upon movement of the light box a predetermined distance relative to the support frame.

7. A light fixture apparatus configured to be mounted to a wall of a room, the apparatus comprising:

a support frame including a track and including first and second support walls configured to be mounted generally parallel to the wall of the room and a web interconnecting the first and second support walls;

a fight box coupled to the support frame by fasteners which permit limited movement of the light box relative to the support, the light box including a light source;

a mounting block configured to be coupled to the track of the support frame, the mounting block being adapted to receive an accessory item to couple the accessory item to the support frame; and a switch coupled to the support frame and engaging the light box for disconnecting power to a hospital bed power supply upon movement of the light box a predetermined distance relative to the support frame.

8. A light fixture apparatus configured to be mounted to a wall of a room, the apparatus comprising:

a support frame including a track and including first and second support walls configured to be mounted generally parallel to the wall of the room and a web interconnecting the first and second support walls;

a light box coupled to the support frame, the light box including a light source;

a mounting block configured to be coupled to the track of the support frame, the mounting block being adapted to receive an accessory item to couple the accessory item to the support frame; and an auxiliary light source coupled to the support frame, the auxiliary light source being movable from a first storage position to a second deployed position for providing auxiliary lighting.

9. The apparatus of claim 8, wherein the auxiliary light source is pivotably coupled to the support frame above the light box.

10. The apparatus of claim 8, wherein first and second auxiliary light source modules are coupled to the support frame at opposite ends of the light box.

11. The apparatus of claim 10, wherein the first and second auxiliary light modules are pivotable upwardly to direct first and second auxiliary light sources toward a patient.

12. The apparatus of claim 10, wherein the first and second auxiliary light modules include a top fixed compartment portion and a bottom movable compartment portion, the movable compartment portion being pivotable downwardly to expose first and second auxiliary light sources within the first and second auxiliary light modules.

13. A light fixture apparatus configured to be mounted to a wall of a room, the apparatus comprising:

a support frame including a track and including first and second support walls configured to be mounted generally parallel to the wall of the room and a web interconnecting the first and second support walls;

a light box coupled to the support frame, the light box including a light source;

a mounting block configured to be coupled to the track of the support frame, the mounting block being adapted to receive an accessory item to couple the accessory item to the support frame; and first and second hollow housing portions coupled to the support frame opposite sides of the light box.

14. The apparatus of claim 13, wherein the first and second housing portions are pivotably coupled to the support frame.

15. A light ire apparatus configured to be mounted to a wall of a room, the apparatus comprising:

a support frame including a track and including first and second support walls configured to be mounted generally parallel to the wall of the room and a web interconnecting the first and second support walls;

a light box coupled to the support frame, the light box including a light source;

first and second stops adjacent the track; and an S-shaped mounting block having a top end configured to engage the first stop and a bottom end configured to engage the second stop, the mounting block being adapted to receive an accessory item to couple the accessory item to the support frame.

16. The apparatus of claim 15, wherein the track is formed to include a recessed portion for receiving a fastener for coupling the mounting block to the accessory item.

17. A light fixture apparatus configured to be mounted to a wall of a room, the apparatus comprising:

a support frame including a track and including first and second support walls configured to be mounted generally parallel to the wall of the room and a web interconnecting the first and second support walls;

a light box coupled to the support frame, the light box including a light source;

first and second stops on the track; and a mounting block including a top end for engaging the first stop and a release latch pivotably coupled to the mounting block for engaging the second stop to hold the mounting block within the track, the mounting block being adapted to receive an accessory item to couple the accessory item to the support frame.

18. The apparatus of claim 17, wherein the release latch is biased to a locking position by a spring coupled between the release latch and the mounting block.

* * * * *